United States Patent [19]

Stubbs

[11] 4,446,016

[45] May 1, 1984

[54] SOLIDS COLLECTING APPARATUS FOR A VACUUM DRAIN SYSTEM

[75] Inventor: Kenneth W. Stubbs, Portland, Oreg.

[73] Assignee: Kenrod Enterprises, Portland, Oreg.

[21] Appl. No.: 475,886

[22] Filed: Mar. 16, 1983

[51] Int. Cl.[3] ..... B01D 21/24

[52] U.S. Cl. ..... 210/86; 210/116; 210/124; 210/312

[58] Field of Search ..... 210/86, 91, 114, 116, 210/119, 124, 125, 302, 303, 312; 433/92, 97

[56] References Cited

U.S. PATENT DOCUMENTS

| | | | |
|---|---|---|---|
| 1,248,996 | 12/1917 | Beck | 210/312 |
| 1,314,566 | 9/1919 | Bogna | 210/312 X |
| 1,679,033 | 7/1928 | Holmes | 210/312 X |
| 2,132,983 | 10/1938 | Call | 210/312 |
| 2,529,843 | 11/1950 | Kehler | 210/86 X |
| 2,697,523 | 12/1954 | Bloksma | 210/312 X |

*Primary Examiner*—John Adee

*Attorney, Agent, or Firm*—Daniel P. Chernoff

[57] ABSTRACT

An apparatus is provided for collecting solids out of a waste mixture of liquid and solids flowing in a vacuum drain system. The apparatus includes a self-actuating valve means for regulating the flow of waste mixture from a reservoir which accumulates the mixture into a separator where the mixture is differentiated into its solid and liquid parts. The liquid is drawn off through a drain assembly which is attched to the vacuum drain system. The apparatus further includes an indicator to indicate when a certain quantity of solids has been collected to the separator.

14 Claims, 3 Drawing Figures

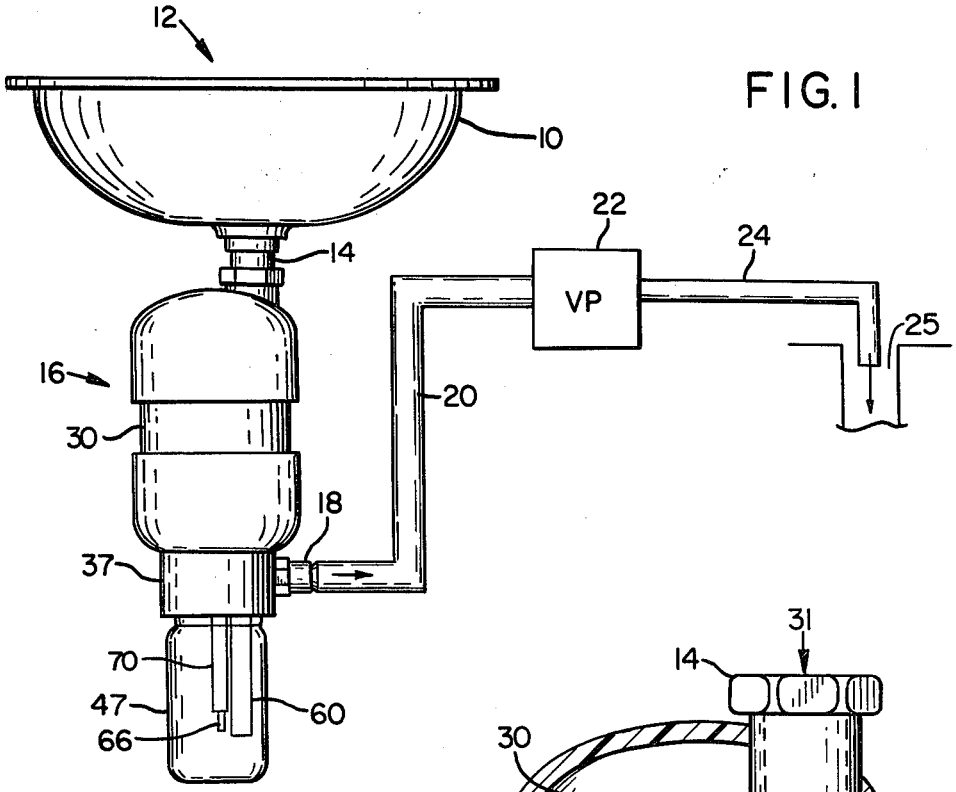
FIG. 1
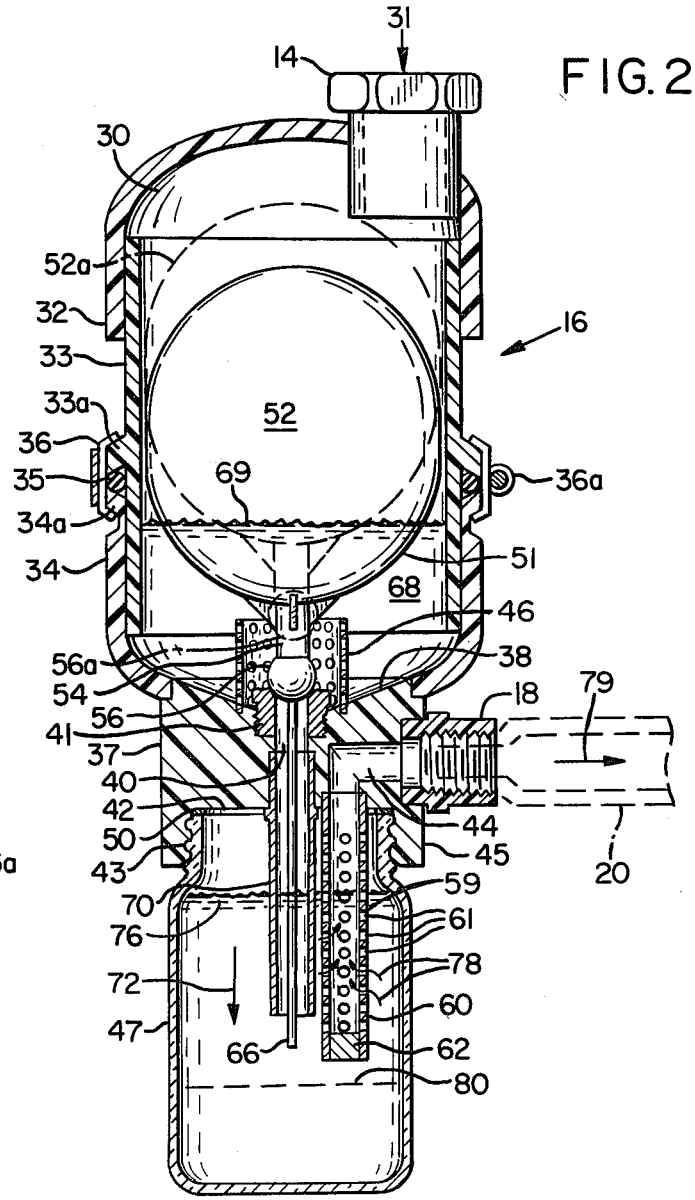
FIG. 2
FIG. 3
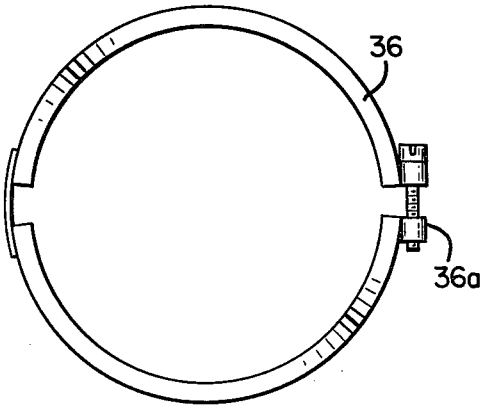

SOLIDS COLLECTING APPARATUS FOR A VACUUM DRAIN SYSTEM

BACKGROUND OF THE INVENTION

The invention disclosed and claimed herein relates to an apparatus for recovering solids which are suspended in waste mixture of liquid and solids being evacuated in vacuum drain system. More particularly, the invention is concerned with the extraction of solids contained in a compound liquid waste such as is produced in a dental clinic and carried away by a vacuum drain system connected to one or more drain sources such as sinks.

In the practice of dentistry, compound liquid waste, comprising water, chemicals, metal particles, and soap emulsion, is produced from such activities as hand washing, dental surgery, dental maintenance, and dental chemistry. The waste is disposed of through sinks and cuspidors in a dental clinic. To complete the disposal, most dental offices now use vacuum-assisted waste disposal systems which collect and process the waste and carry it to a sewage drain.

The compound liquid waste is collected and processed in order to extract and salvage some of the solid materials, such as gold and silver, which are suspended in it. It is also desirable to extract as much of the rest of the solid material as possible in order to prevent it from clogging either the drain system, the sewage system, or both.

The art shows a number of existing vacuum drain systems which separate solid waste from a mixture of liquid and suspended solids. An example of a vacuum-assisted liquid waste disposal system which separates solids from the waste is found in the *A-dec Systems Guide* which lists and describes equipment available from A-dec, Inc., Newberg, Oreg. In the A-dec vacuum drain actuator assembly, liquid waste compound flows from a cuspidor or sink drain into a chamber. A vacuum microvalve is adapted to sense the total mass of the waste in the chamber. While the liquid waste compound accumulates in the chamber, the solids suspended therein settle out through an opening in the bottom of the chamber to a solids collector jar. When the microvalve senses that a given amount of liquid waste compound has accumulated in the drain chamber, it sends a pneumatic signal to a vacuum-operated drain valve which causes the drain valve to open, allowing the remaining liquid to flow out of the chamber. As the level of liquid in the drain chamber falls, the microvalve changes state and closes the drain valve so that more waste compound can enter the chamber to be separated into its liquid and solid components.

While the A-dec assembly is efficient in separating solids from the liquid waste, it depends for its operation on an expensive, precision pneumatic control and valve assembly. Both the microvalve and the air controlled drain valve are susceptible to being jammed by the solids suspended in the liquid waste compound and are difficult to repair and maintain. Also, the interconnection of the control and valve assembly by an air hose network increases the chance of a system malfunction which can result from damage to one of the hoses. Moreover, the assembly provides no indication of the amount of solids collected, which would be useful in signalling an operator to change or empty the solids collection jar. Finally, if the vacuum system fails to operate while waste continues to accumulate in the assembly, eventually the waste will back up the drain and overflow the basin.

For the foregoing reasons it is highly desirable that an on-line solids collecting means be provided for extracting the solid material from compound liquid waste being evacuated in a vacuum drain system, and that such solids collecting means be characterized by having in simple arrangement few moving parts which are actuated by simple techniques, which require no adjustment, and which are easily repaired. In addition, it would be convenient to an operator if such a means provided an indication when the amount of solids removed exceeded a predetermined level so that the operator could take action to remove the collected solids. Further, it would be desirable for such a solids collecting means to be able to continue to drain waste from a sink even in the event of a failure of the vacuum.

SUMMARY OF THE INVENTION

The present invention provides a simple, effective, and economical apparatus for removing solids from a compound liquid waste flowing in a vacuum-assisted drain system. In an illustrative embodiment, the apparatus has a simple valve assembly for admitting the waste mixture of liquid and suspended solids into a separator where the solids settle out, allowing the liquid to be extracted by a drain assembly for discharging into the drain system.

The solids collecting apparatus of the present invention comprises a reservoir for accumulating the liquid waste compound as it flows from a sink or cuspidor. A self-actuating valve assembly senses the amount of waste accumulated in the reservoir and, when a predetermined amount has accumulated, opens itself to allow the accumulated amount to flow through a strainer and an aperture in the reservoir, and then into a separator positioned beneath the reservoir. The waste compound is held in the separator to allow the solids to settle out and separate from the liquid. A drain assembly, connected to the vacuum drain system, is disposed within the separator to intermittently drain off a quantity of the separated liquid for discharging into the drain system. The quantity of liquid remaining in the separator balances the vacuum pressure of the drain system. A rod is provided on the valve assembly and disposed to extend downward through the opening into the separator where it senses the level of the settled solids. When the level of the solids rises up to contact to the end of the rod, the valve assembly is prevented from seating to close the opening, and an audible sound is heard signaling an operator to change or empty the separator. Because the valve assembly is selfactuated by a simple arrangement of hydro-mechanical parts which can operate without the vacuum, the solids collecting apparatus will continue to drain waste from a sink should the system vacuum fail.

It is therefore a principal objective of the present invention to provide a novel and improved apparatus for the efficient and simple separation of solids from a compound waste mixture of liquids and solids flowing in a vacuum-assisted drain system.

It is a still further objective of the present invention to provide an apparatus for extracting solids from a mixture of liquids and solids flowing in a vacuum-assisted drain system which is inherently simpler and therefore more reliable than any heretofore known.

It is a principal advantage of the present invention that an apparatus for extracting solids from a waste mixture of liquids and solids has a simplified valve assembly which can control its own operation and which enhances the operational reliability of the apparatus.

It is another important advantage of the present invention that there is provided an apparatus for extracting solids from a mixture of liquids and solids having an indicator for sensing the amount of solids extracted and providing an indication when that amount exceeds a predetermined level.

It is a further advantage of the present invention that its simple arrangement of parts allows it to continue to drain waste material from a sink in the event of a failure of the drain system vacuum source.

The foregoing and other objectives, features and advantages of the present invention will be more readily understood upon consideration of the following detailed description of the invention, taken in conjunction with the accompanying drawings.

BRIEF DESCRIPTION OF THE DRAWINGS

FIG. 1 is a general view showing the interconnection of the apparatus of the invention with a vacuum-assisted waste disposal system.

FIG. 2 is a cross-sectional view of the apparatus of the invention.

FIG. 3 is a top view of a means for sealing a housing used in the invention.

DESCRIPTION OF THE PREFERRED EMBODIMENT

Referring now to the drawings there is shown in FIG. 1 a cuspidor 10 for funneling waste such as is expectorated or aspirated by a patient undergoing dental treatment. Normally included with a sink or in a cuspidor would be a source of flowing water, not shown, to flush the waste material into the attached drain system.

Immediately beneath the cuspidor 10 and attached to its drain outlet by way of a plumbing union 14 is the solids collecting apparatus of the invention, indicated generally by 16. The solids collecting apparatus 16 is connected by way of an airtight plumbing union 18 to a hermetic vacuum line 20 which is also connected to a vacuum pump 22 (VP). The vacuum pump 22 is connected to a sewage system discharge connection 24 which empties into a typical gravity sewage system through port 25.

In operation, a waste including solid material is discharged into the cuspidor 10 in the direction indicated by the arrow 12. The waste mixes with the water in the cuspidor 10 and the mixture exits the cuspidor 10 under the force of gravity through the plumbing union 14 and into the solids collecting apparatus 16. In a manner described herein below, the mixture is resolved in the solids collecting apparatus into separate solid and liquid components and the liquid component is evacuated from the solids collecting apparatus 16 by the vacuum system through the airtight fitting 18, the hermetic line 20, and the vacuum pump 22 whence it exits through the sewage system discharge pipe 24 and enters the gravity sewage system port 25.

The solids collecting apparatus 16 of the invention is not limited to be used with one cuspidor or sink of any particular type. It can be used with any single source of waste, or as a single collection point for several sinks and cuspidors for which access can be provided through a multiport plumbing manifold attached to the conventional plumbing coupling 14.

Referring now to FIG. 2, it will be possible to understand the structure and operation of the solids collector 16. A reservoir 30 accumulates the mixture of solids and water which is introduced into the reservoir 30 from the cuspidor 10 through the conventional plumbing coupling 14 in the direction indicated by the arrow 31.

The reservoir 30 is formed from a housing comprising a cylindrical top housing piece 32 which is closed at one end, an open cylindrical middle housing piece 33, and a cylindrical bottom housing piece 34 which is partially closed at one end. The top housing piece 32 is attached to and closes one end of the middle housing piece 33. The middle piece 33 has an undercut circumferential flange **33*a* at its midsection. The bottom housing piece 34 has a circumferential groove 34*a* near its upper end 34*b*. The upper end 34*b* of the bottom housing piece 34 is biased to a relatively sharp edge which slopes away to the inner surface of the bottom housing piece 34. The middle housing piece 33 is adapted to slide into the bottom housing piece 34 until its circumferential flange 33*a* contacts the upper edge 34*b* of the bottom piece. When the reservoir is assembled, the top and middle housing pieces 32 and 33 are permanently joined together; the middle and bottom housing pieces 33 and 34 are slid together with an O-ring 35 placed between the flange 33*a* and the upper edge 34*b*; and, a screw-adjustable ring clamp 36, such as a marmon clamp or equivalent, is placed to span and engage the middle housing piece flange 33*a* and the bottom housing piece groove 34*a*. The ring clamp 36 is also illustrated in FIG. 3. When the ring clamp 36 is tightened by rotating its tangential tightening screw 36*a* in one direction, its circumference contracts and its edges press against the outer edge of the flange 33*a* and the upper side of the groove 35*a*, moving the flange 33*a* and upper edge 34*b* toward each other which causes them to form a watertight seal with the O-ring 35. The clamping action also holds the middle housing piece 33 and bottom housing piece 34** together.

A manifold 37 is joined to the lower end of the bottom housing piece 34 and has a generally cone-shaped upper surface 38 which slopes toward a central axial aperture 40, widened and threaded at its upper end to accept a threaded, axially bored valve seat 41, which may be a bored brass hex nut or equivalent. At its lower end, the central aperture 40 opens into the lower surface 42 of the manifold 37. At its lower end, the manifold 37 has a threaded side surface 43. The manifold 37 has a right-angled passageway 44 which opens at one end on the lower surface 43 and, at its other end, on the outer side surface 45 of the manifold. An annular strainer 46 is seated in the upper surface 38 and surrounds the valve seat 41.

A separator 47 includes a jar or other container having a threaded upper end which engages the lower, threaded inner surface 43 of the manifold 37. A seal 50, for example, an O-ring, is placed between the separator 47 and the lower surface 43 of the manifold 37.

A self-actuating valve assembly 51, whose operation is explained hereinbelow, includes a float 52 having a lower extension 54 to which is attached a ball valve 56. In the arrangement of parts illustrated in FIG. 2, when the ball valve 56 rests on the valve seat 41 as illustrated, the upper end of the central aperture 40 is sealed.

A drain assembly 59 includes a perforated pipe 60 having a plug 62 at one end and holes, as for example at 61, extending through its surface. The perforated pipe 60 is fixed in the manifold 37 and aligned therein to be coaxial with one end of the right-angled pasageway 44. The airtight plumbing connector 18 is fixed to the manifold 36 and aligned to be coaxial with the other end of the right-angled passageway 44.

A solids level indicator includes a rod 66 which is attached to the float 52 and which extends downward therefrom through the ball valve 56, the central aperture 40 of the manifold 37, and substantially into the separator 46.

In operation, the initial state of the solids collecting apparatus 16 is established when the vacuum system is connected to the solids collector 16 through the airtight plumbing connector 18 and placed into operation to create a vacuum. The vacuum is introduced into the separator 47 through the plumbing fixture 18, by way of the right-angled passageway 44 and the perforated pipe 60. The vacuum is maintained in the separator 57 by the seal 50 and by the seating of the ball valve 56 in the valve seat 41 which seals the central aperture 40 of the manifold 37. The vacuum, acting through the central aperture 40, tends to hold the ball valve 56 in place in the valve seat 41.

The solids collecting apparatus 16 begins operation when solid waste mixed with water is flushed from the cuspidor 10 into the solids collecting apparatus 16 in the direction indicated by the arrow 31 through the conventional plumbing coupling 14. The flushing is an intermittent process and, as it continues, an accumulation of mixture 68 collects in the bottom of the reservoir 30. The upper surface 69 of the mixture accumulation 68 urges the float upward but the upward force on the float is resisted by the force of the vacuum acting on the ball valve 56 which tends to hold the float 52 in place. Eventually, enough of the mixture accumulates to increase the upward displacement force exerted by the mixture on the float 52 to a point where it overcomes the downward force exerted by the vacuum on the ball valve 56. When this point is reached, the float 52 and attached ball valve 56 move upward to the position indicated by dashed lines **52*a* and 56*a*, and the accumulated mixture 68 is pulled through the annular strainer 46 and into the central aperture 40 by the combination of the force of gravity and the vacuum. The annular strainer 46 acts to strain out large pieces of solid material which might otherwise lodge in the valve seat 41 and prevent the seating of the ball valve 56** thereon.

When the reservoir 30 is emptied, the float 52 and ball valve 56, urged by the combination of gravity and the vacuum, move back to their initial position indicated by numerals 52 and 56, whereupon the central aperture 40 through the manifold 37 is once again sealed by the seating of the ball valve 56 in the valve seat 41. In this manner, the valve assembly comprising the float 52 and ball valve 56 regulates the flow of waste mixture into the solids collecting apparatus 16.

The alignment of the ball valve 56 and the valve seat 41 is maintained by the rod 66 which extends through the valve seat 41 and the central aperture 40 into the separator 47. This aligning operation can be aided by the provision of a tube 70 fixed in the manifold 37 and concentric with the central passageway 40, one end of the tube 70 extending part way into the separator 47 and the other end part way into the widened lower end of the central passageway 40. The tube 70 restricts the side-to-side motion of the rod 66 and the ball valve 56 which keeps the ball valve 56 centered with respect to the valve seat 41.

With each oscillation of the float 52 up and down within the reservoir 30, the accumulated mixture 68 flows from the reservoir 30 through first strainer 46 and the central aperture 40 of the manifold 37 and into the separator 47 where it is held. In the separator 47 the solids contained within the mixture settle out from the mixture by falling under the force of gravity in the direction indicated by the arrow 72. The result is a resolution of the mixture into a lower part largely comprising settled-out solids and an upper part, largely comprising liquid. As more mixture is discharged from the reservoir, the level of the liquid in the separator 47 rises to an equilibrium point 76 beyond which the force of the vacuum will act to draw out through the drain assembly 59 excess liquid which accumulates above the equilibrium point 76. The excess is drawn out through the holes 61 in the perforated pipe 60 in the direction shown by the arrows 78. From there it is swept by the vacuum through the airtight plumbing connector 18 in the direction indicated by the arrow 79, and then through the vacuum drain system from where it is discharged into the gravity sewage system port 25. The liquid equilibrium level 76 is determined largely by the force of the vacuum: for a strong vacuum, it will be lower than for a weak one.

The solids collector 16 is self-monitoring in that it senses when the amount of the solids collected in the separator 47 exceeds a certain level and then provides an alarm when that amount of solids is present. This is accomplished by the rod 66. When enough solids have settled out and dropped to the bottom of the separator 47, they will reach a level indicated by the dashed line at 80 where the end of the rod 66 will come to rest and prevent the seating of the ball valve 56 on the valve seat 51 at the top of the central aperture 40 of the manifold 37. When this occurs a sound is produced when air, under the force of the vacuum, is accelerated around the end of the ball valve and sucked through the central aperture 40. When the sound is heard, the operator of the system will understand that the separator 47 must be changed or emptied.

It is an important feature of the invention that, should the vacuum fail, liquid waste will continue to drain through the solids collecting apparatus 16 and into the drain system. This happens because the float 52 will continue to unseat the ball valve 56 from the valve seat 41 to open the central aperture 40 as liquid waste mixture accumulates in sufficient quantity to buoy the float up. Since the plumbing connection 18 is beneath the bottom of the reservoir 30, when the separator 47 fills, the mixture will rise through the drain assembly 59 into the right-angled passageway 44, and out through the plumbing connection 18 into the drain system. Thus, should the water source in the cuspidor 10 be inadvertently left on while the vacuum system is off, the valve assembly 51 of the solids collector will continue to operate and will keep the cuspidor from overflowing.

Another important feature of the solids collecting apparatus of the invention is that its maintenance burden is limited by virtue of its simple structure. Should the float assembly fail to function properly, for example, the float 52 should be punctured, or the valve seat 41 clogged or damaged, the reservoir 30 can be quickly and easily disassembled to perform the needed correction simply by loosening the ring clamp 36 and sliding the middle housing piece 33 out of the bottom housing piece 34. Reassembly is then performed by reversing those steps.

Common materials and components may be used to construct the embodiment of the invention. All pipes and tubing within the solids collecting apparatus may be standard Schedule 40 PVC 1 plastic pipe or its equivalent. The collector housing 30 can be constructed of molded plastic parts which are joined together after assembly of the float 52, ball valve 56, lower extension 54, and rod 66. The manifold can be constructed from a suitably machined block of plastic. The final assembly of the reservoir 30, manifold 37, and drain assembly pipe 60 can be by gluing or clamping.

The present invention teaches the structure and operation of a solids collecting apparatus for use in a vacuum drain system to separate solids contained in the liquid waste flowing in the system. The apparatus has a simple, efficient self-actuating valve assembly, and a means for indicating an amount of solids collected.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for extracting solids from a mixture of liquid and solids flowing in a vacuum drain system, the apparatus comprising:

(a) separator means for separating said solids in said mixture from said liquid;

(b) drain means connected to said vacuum drain system for draining said liquid from said separator means;

(c) reservoir means for accumulating said mixture;

(d) aperture means for permitting said mixture to flow between said reservoir means and said separator means; and (e) valve means associated with said aperture means and disposed within said reservoir means for sensing the amount of said mixture in said reservoir means and for moving to an open position which permits said mixture to flow through said aperture means into said separator means when a predetermined amount of said mixture has accumulated in said reservoir means and to a closed position which prevents said mixture from flowing through said aperture means.

2. The apparatus of claim 1 further including indicator means cooperating with said valve means for providing an indication when the amount of said separated solids in said separator means exceeds a predetermined quantity.

3. The apparatus of claim 2 wherein said indicator means comprises a sensor means attached to said valve means for holding said valve means in said open position when said predetermined quantity of separated solids is exceeded.

4. The apparatus of claim 1 wherein said drain means is hermetically disposed within said separator means for introducing a vacuum thereinto, said vacuum acting through said aperture means for drawing said mixture into said separator and for moving said valve means to said closed position.

5. The apparatus of claim 1 wherein said valve means comprises a float means for floating on said accumulated mixture, and a stopper means disposed on said float means adjacent said aperture means for opening said aperture means when said valve means moves to said open position and for closing said aperture means when said valve means moves to said closed position.

6. The apparatus of claim 5 further including indicator means cooperating with said stopper means for providing an indication when the amount of said separated solids in said separator means exceeds a predetermined quantity.

7. The apparatus of claim 6 wherein said sensor means comprises a rod in fixed spatial relationship with said stopper means and extending through said aperture means into said separator means.

8. The apparatus of claim 1 further comprising strainer means adjacent said aperture means for preventing the passage of relatively large solid particles therethrough.

9. An apparatus for separating a mixture of solids and liquids in a vacuum drain system, said drain system having a vacuum introduced thereinto, said apparatus comprising:

(a) separator means for separating said solids in said mixture from said liquid;

(b) reservoir means for accumulating said mixture, said reservoir means including aperture means for permitting said mixture to flow between said reservoir means and said separator means; and (c) valve means disposed within said reservoir means and responsive to the amount of mixture accumulated therein for moving to an open position when said mixture accumulation exceeds a predetermined amount, said open position permitting said mixture to flow through said aperture means, and for moving to a closed position when said mixture accumulation is less than said predetermined amount, said closed position preventing said mixture from flowing through said aperture means.

10. The apparatus of claim 9 wherein the valve means comprises:

(a) a float disposed within said reservoir means; and (b) a stopper disposed on said float adjacent said aperture means.

11. The apparatus of claim 9 wherein said separator means further includes drain means coupled to said drain system for draining said liquid from said separator means.

12. The apparatus of claim 11 wherein said vacuum is introduced into said apparatus through said drain means and said valve means is moved to said closed position by a force comprising said vacuum.

13. The apparatus of claim 9 further including indicator means for providing an indication when the amount of said separated solids exceeds a predetermined quantity.

14. The apparatus of claim 9 further including means adjacent said aperture means for preventing the passage of relatively large solid particles therethrough.

* * * * *